US007220316B2

(12) United States Patent
Kitsuwa

(10) Patent No.: US 7,220,316 B2
(45) Date of Patent: May 22, 2007

(54) WIRE MATERIAL PLATING EQUIPMENT

(75) Inventor: Tomio Kitsuwa, Osaka (JP)

(73) Assignee: Sakuratech Co. Ltd., Osaka (JP)

( * ) Notice: Subject to any disclaimer, the term of this patent is extended or adjusted under 35 U.S.C. 154(b) by 218 days.

(21) Appl. No.: 10/500,108

(22) PCT Filed: Aug. 21, 2002

(86) PCT No.: PCT/JP02/08397

§ 371 (c)(1),
(2), (4) Date: Jul. 27, 2004

(87) PCT Pub. No.: WO03/060176

PCT Pub. Date: Jul. 24, 2003

(65) Prior Publication Data

US 2005/0103263 A1 May 19, 2005

(30) Foreign Application Priority Data

Dec. 27, 2001 (JP) ..... 2001-403207

(51) Int. Cl.
*B05C 13/00* (2006.01)

(52) U.S. Cl. ..... 118/68; 118/69; 118/420

(58) Field of Classification Search ..... 118/420, 118/63, 69, 423, 125, 66–68; 62/63, 407; 427/349, 398.1, 398.4, 398.5, 436, 374.1, 427/374.4; 266/111, 251, 259
See application file for complete search history.

(56) References Cited

U.S. PATENT DOCUMENTS 2,736,548 A * 2/1956 Orr et al. ..... 165/109.1

(Continued)

FOREIGN PATENT DOCUMENTS

JP 4-18344 6/1992

(Continued)

*Primary Examiner*—Brenda A. Lamb
(74) *Attorney, Agent, or Firm*—Squire, Sanders & Dempsey L.L.P.

(57) ABSTRACT

An apparatus for plating a wire material is provided in which a range of the plated layer where the temperature is high and flowability is large, thus, easily generating thickness deviation, and a range of the plated layer where the temperature is low and the flowability is small, thus generating thickness deviation only with difficulty are allowed to cool in an appropriate manner, respectively, whereby a plated wire material whose thickness deviation is not more than 2.0 can be produced with high productivity in a stable manner.

In an apparatus for plating a wire material having an air cooling device provided on an upper portion of a plate-squeezing portion on a plating bath surface so that the wire material is standing up from the plating bath via the plate-squeezing portion, the air cooling device comprising an air compressor portion, a lower cooling portion below the air compressor portion, and an upper cooling portion above the air compressor potion; the wire material passing through the air cooling device is air-cooled in two stages by a main cooling air flowing from an air injection hole of the air compressor portion into the upper cooling portion then flowing out from the upper cooling portion from an exit at an upper end and by a secondary cooling air, being sucked into the main cooling air, flowing from an inlet of the lower cooling portion at the lower end thereof into the lower cooling portion and then being jointed to the main cooling air.

2 Claims, 13 Drawing Sheets

U.S. PATENT DOCUMENTS 4,171,394 A * 10/1979 Patil et al. ..... 148/533

FOREIGN PATENT DOCUMENTS

JP 10-60615 3/1998
JP 11-323524 11/1999
JP 2000-45056 2/2000

* cited by examiner

WIRE MATERIAL PLATING EQUIPMENT

TECHNICAL FIELD

The present invention relates to an apparatus for plating a wire material in a manner that plating-squeezing is performed by a non-oxidized gas or a charcoal squeezing.

BACKGROUND ARTS

In the case where thick-plating is applied on a wire material in an applied amount of not less than 400 g/m$^2$ through molten zinc plating or molten zinc-aluminum alloy plating, it is difficult to obtain a plated wire material with good outward appearance having a uniform thick plated layer, due to the movement of the applied plated layer through the vibration generated during the course of transferring the wire material itself before coagulation. This leads to a thickness deviation ratio, which is a value obtained by dividing the maximum thickness of the plated layer by the minimum thick layer) arriving at from 3 to 5, causing a problem in terms of insufficient linear/diameter tolerance, deterioration of anti-corrosion properties and the like.

We have developed apparatuses for plating a wire material disclosed in Japanese Patent Laid-Open No. 10-60615 and No. 11-323524, and have conducted improvements where adhered molten plated layer is allowed to cool down by a forcibly cooling device in the same apparatus to decrease the flowability, whereby a plated wire having a uniform thick plated layer and good outward appearance can be obtained.

As a result, the use of such apparatuses makes it possible to improve a thickness deviation ratio of 2.0 or less. However, it has been difficult to produce a plated wire having a thickness deviation ratio of 2.0 or less in a stable manner.

In addition, the forcibly cooling device described above can only pass one wire, resulting in poor productivity. Further, at the time of the breakage, a lot of loss is caused during the course of again passing the wire, and at the time of detaching the cooling device, there is a problem in terms of workability such as cutting off the plated wire.

SUMMARY OF THE INVENTION

A first object of the present invention is to provide an apparatus for plating a wire material in which a range of the plated layer where the temperature is high and flowability is large, thus, easily generating thickness deviation, and a range of the plated layer where the temperature is low and the flowability is small, thus generating thickness deviation only with difficulty are allowed to cool in an appropriate manner, respectively, whereby a plated wire material whose thickness deviation is not more than 2.0 can be produced with high productivity in a stable manner; a second object of the present invention is to provide an apparatus for plating a wire material, which can further produce a wire material whose outward appearance of the surface of the plated layer is good on a large scale; a third object of the present invention is to provide an apparatus for plating a wire material, which can simultaneously produce a plurality of wire materials whose outward appearance of the surface of the plated layer is good; and a forth object of the present invention is to provide an apparatus for plating a wire material, which can simultaneously produce a plurality of wire materials whose outward appearance of the surface of the plated layer is good, and which is of good workability at the time of breakage and easily carrying out maintenance of the apparatus.

1. The present invention is an apparatus for plating a wire material having an air cooling device provided on an upper portion of a plate-squeezing portion on a plating bath surface so that the wire material is standing up from the plating bath via the plate-squeezing portion, said air cooling device comprising an air compressor portion, a lower cooling portion below the air compressor portion, and an upper cooling portion above the air compressor potion;

wherein the wire material passing through the air cooling device is air-cooled in two stages by a main cooling air flowing from an air injection hole of said air compressor portion into the upper cooling portion then flowing out from the upper cooling portion from an exit at an upper end and by a secondary cooling air, being sucked into said main cooling air, flowing from an inlet of he lower cooling portion at the lower end thereof into the lower cooling portion and then being jointed to the main cooling air.

2. The present invention also concerns the apparatus for plating a wire material as set forth in Item 1, which further comprises a plate for preventing turbulence flow, which suppresses the turbulence of the cooling air provided within the upper cooling portion and/or the lower cooling portion so as to form a laminar air flow space of the cooling air through the plate for preventing turbulence.

3. The present invention is also directed to the apparatus for plating a wire material as set forth in Item 1, which comprises a plurality of plates for preventing turbulence flow, which suppress the turbulence of the cooling air provided on opposite portions in the cross-machine direction each beside a portion along a passing orbit direction of each wire material arranged in one column in the machine direction to form a plurality of laminar air flow spaces of the cooling air separated by neighboring plates for preventing turbulence flow in the machine direction and cross-machine direction, and wherein the air injection portion of the air compressor portion is communicated with each laminar air flow space, whereby the wire materials can be simultaneously allowed to cool within the laminar air flow spaces.

4. The present invention is also directed to the apparatus for plating a wire material as set forth in Item 1, wherein the wire materials arranged on one column between forked cross-machine edge portions of said air compressor portion simultaneously form depth-needling shaped wire-passing portions, which are simultaneously detachable, which comprises a plurality of plates for preventing turbulence flow, which suppresses the turbulence of the cooling air provided on opposite portions in the cross-machine direction each beside a portion along a passing orbit direction of each wire material arranged in one column in the machine direction to form a plurality of laminar air flow spaces of the cooling air separated by neighboring plates for preventing turbulence flow in the machine direction and cross-machine direction, and a wire material inserting portion having a width wider than the diameter of the wire material provided between the plates for preventing turbulence flow placed in the opposite cross-machine direction and on front wall portions of the upper and the lower cooling portion in vertically accorded with the wire material inserting portion, and a pair of the air injection holes on both edges of said forked portions of said air compressor portion are with each laminar air flow space, whereby the wire materials can be simultaneously allowed to cool within the laminar air flow spaces.

According to the present invention, in Item 1 described above, a plated layer where the temperature is high and flowability is large, thus, easily generating thickness deviation in the wire material immediately after being passed through the plate-squeezing portion is allowed to cool by the secondary cooling air in the laminar air flow state at a low speed, and the plated layer where the temperature is low and the flowability, thus generating thickness deviation only with difficulty, immediately after the cooling by the secondary cooling air is allowed to cool by the main cooling air by a main cooling air in the laminar air flow state at a high speed, whereby effective cooling with suppressing the thickness deviation can be performed, and uniformly thick-plated wires having a small thickness deviation equal to or smaller than that of the conventional product and having good outward appearance can be produced on a large scale in a stable manner.

In Item 2, since the cooling air is further regulated to be in the laminar air flow state by the plate for preventing turbulence, molten thick-plated wires can be produced in much more stable manner, which have a small thickness deviation equal to or smaller than that of the conventional product, and possess good outward appearance.

In Item 3, in comparison with the conventional cooling device, which only can pass one wire, a plurality of wire materials can be simultaneously plated in a stable manner on a large scale, the plated wires of which have a small thickness deviation equal to or smaller than that of the conventional product, and possess good outward appearance.

In Item 4, in comparison with the conventional cooling device, which only can pass one wire, a plurality of wire materials can be simultaneously plated in a stable manner on a large scale, the plated wires of which have a small thickness deviation equal to or smaller than that of the conventional product, and possess good outward appearance. Furthermore, this makes it easy to perform the treatment at breakage and the detach and attach the air cooling device itself and thus, the apparatus for plating a wire material excels in productivity and workability.

BEST MODES FOR CARRYING OUT THE INVENTION

Figure 1:
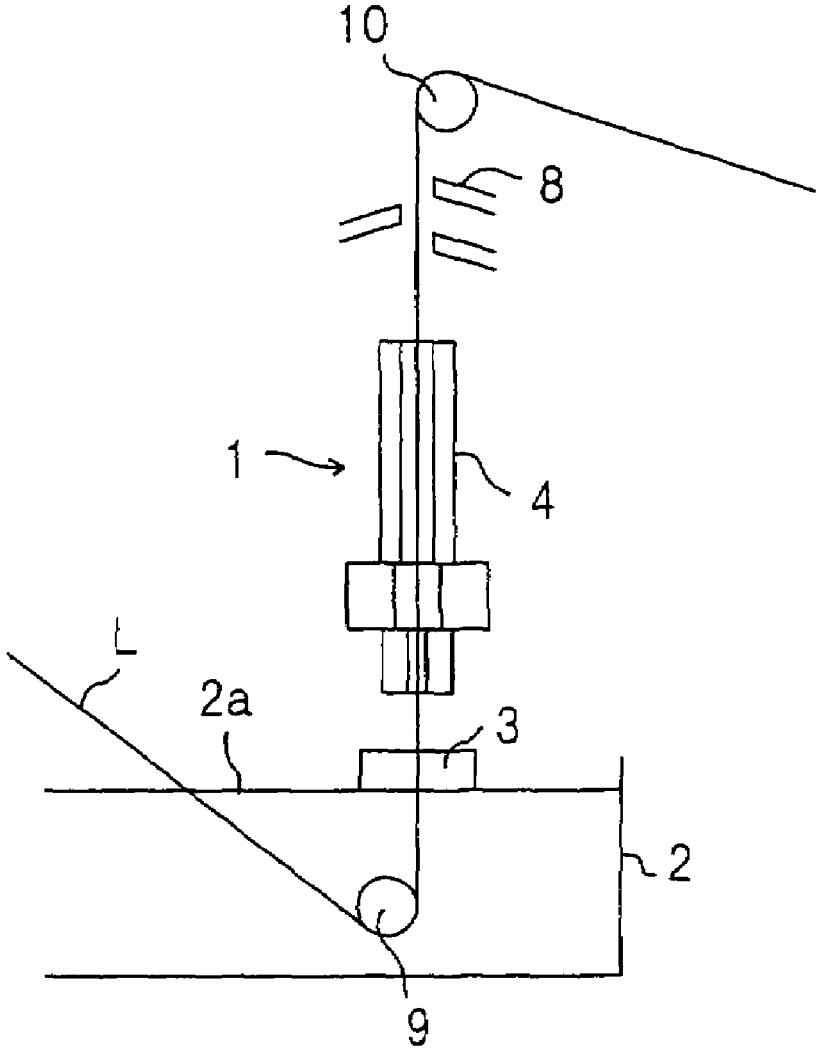
FIG. 1 is a schematic view showing the apparatus for plating a wire material according to one embodiment of the present invention.
Figure 2:
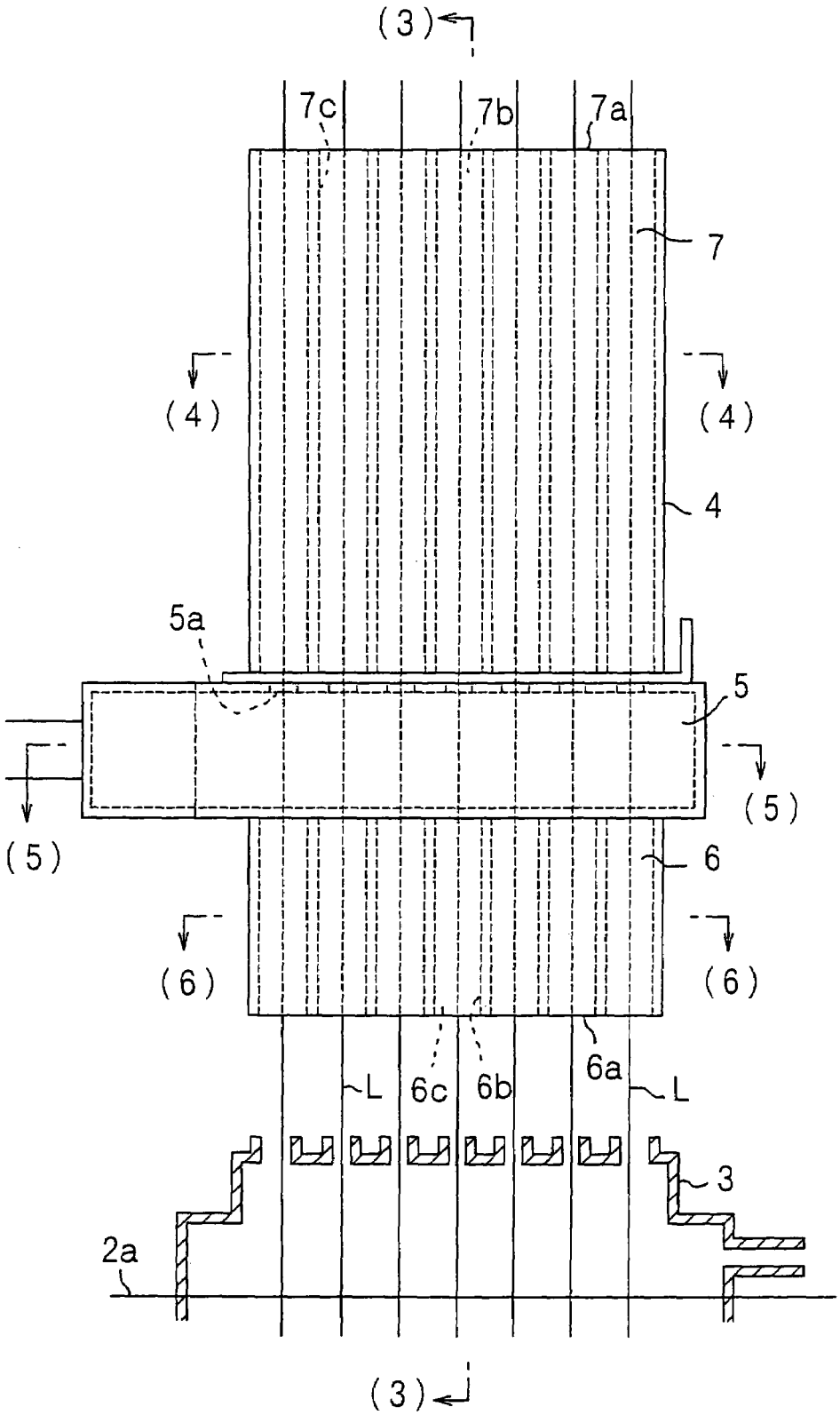
FIG. 2 is an enlarged plane view of the air cooling device of FIG. 1.
Figure 3:
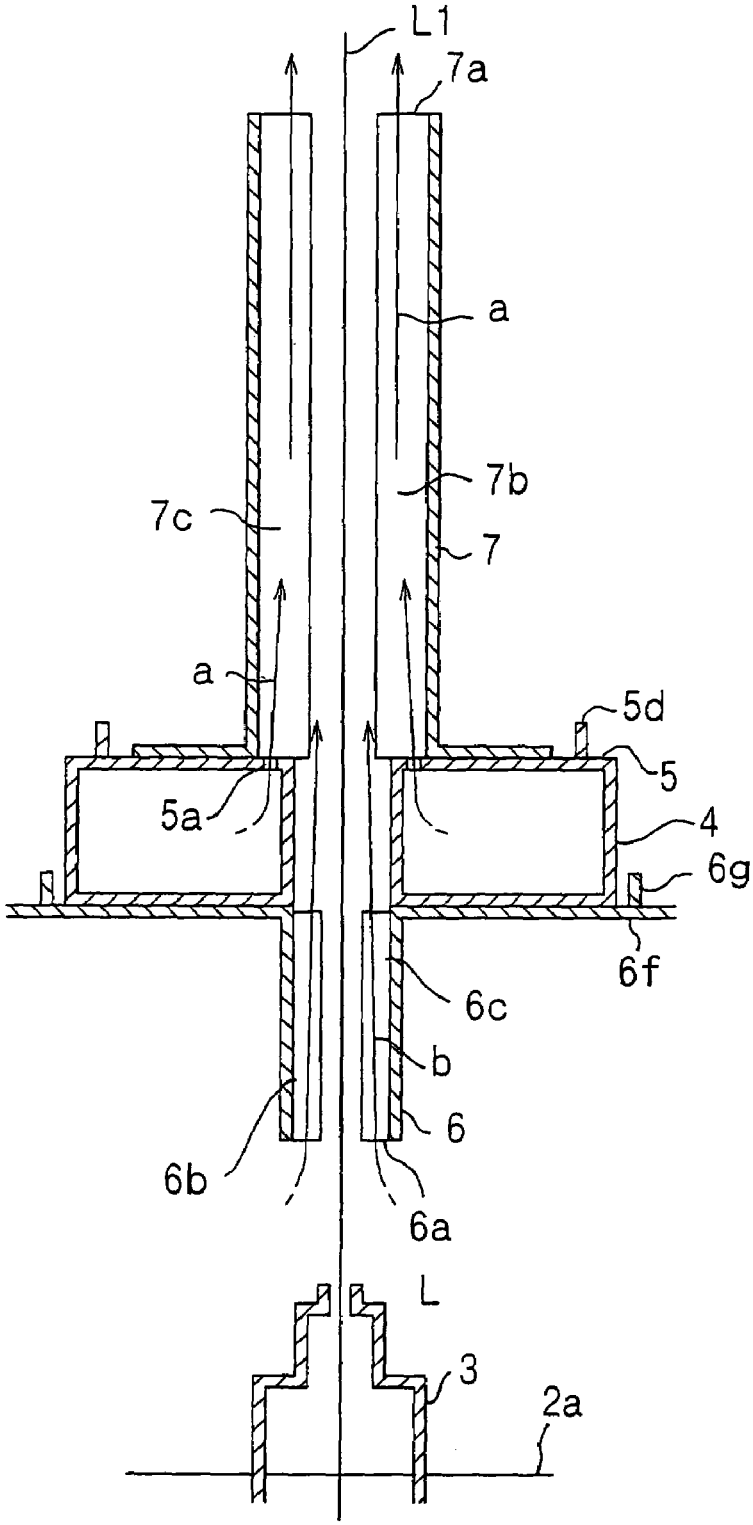
FIG. 3 is a cross-sectional view of FIG. 2 taken along line (3)—(3)
Figure 4:
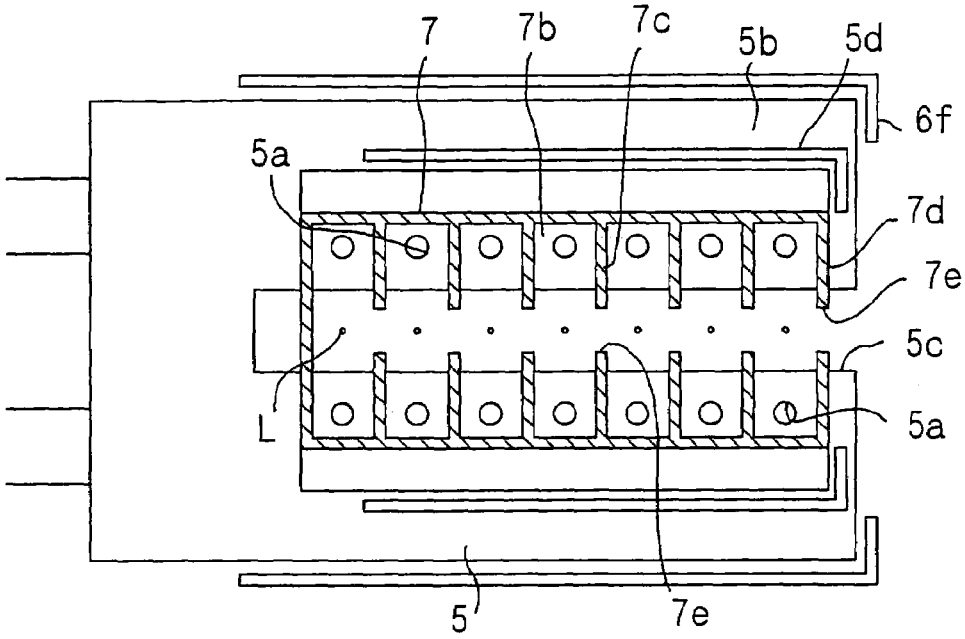
FIG. 4 is a cross-sectional view of FIG. 2 taken along line (4)—(4)
Figure 5:
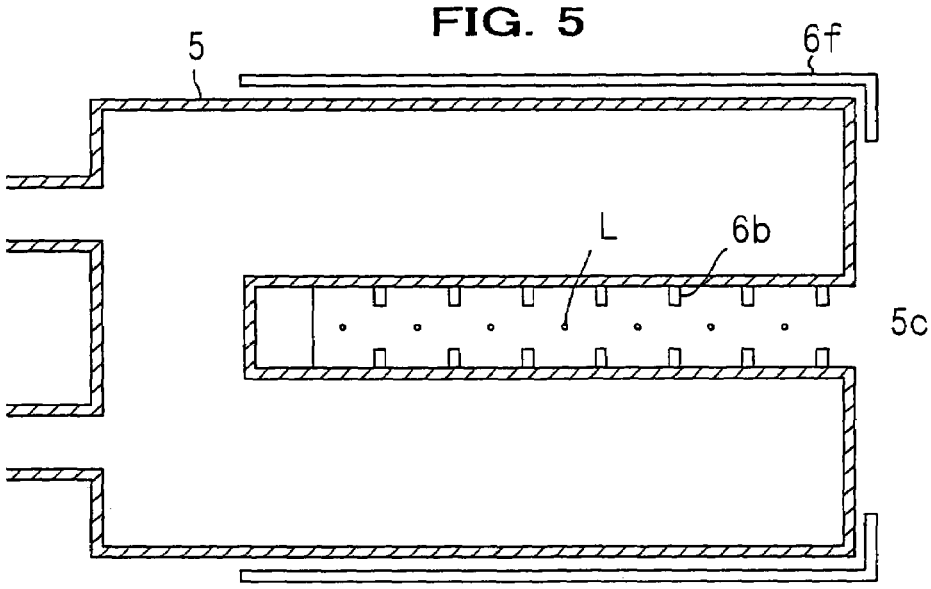
FIG. 5 is a cross-sectional view of FIG. 2 taken along line (5)—(5)
Figure 6:
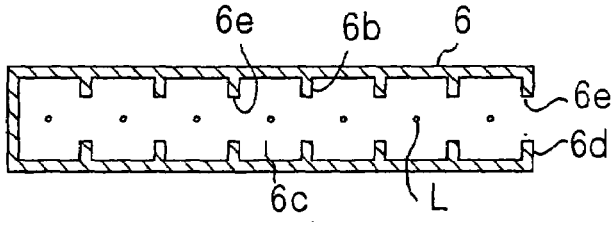
FIG. 6 is a cross-sectional view of FIG. 2 taken along line (6)—(6)

Embodiments of the present invention will now be described.

FIG. 1 to 6 exemplify one embodiment of the apparatus for plating a wire material. The apparatus 1 for plating a wire material has a configuration that an air cooling device 4 is provided on an upper portion of a plate-squeezing portion 3 of a plate bath surface 2*a* of a plating tank 2, and a water cooling apparatus 8 is provided on an upper portion of the air cooling device 4, so that a plurality of wire materials L are passed via sinker rolls from the plate bath surface 2*a* to the plate-squeezing portion 3 covered with a non-oxidative atmosphere, at which the wires are simultaneously standing up, each plated layer L1 is allowed to cool down during the course of passing though the air cooling device 4 and the water cooling device 8, after which the air-cooled and water-cooled wire materials are wound on a drum (not shown) simultaneously via top rolls 10. The water cooling device 8 may not be used as occasion demands.

The air cooling device 4 comprises an air compressor portion 5, a lower cooling portion 6 below the air compressor portion 5, and an upper cooling portion 7 above the air compressor portion 5, so that a plurality of wire materials L are air-cooled in two stages by a main cooling air flowing from an air injection hole 5*a* of the air compressor portion 5 into the upper cooling portion 7 then flowing out from the upper cooling portion 7 from an exit 7*a* at an upper end and by a secondary cooling air, being sucked into the main cooling air, flowing from an inlet 6*a* of the lower cooling portion 6 at the lower end thereof into the lower cooling portion and then being jointed to the main cooling air.

The air compressor portion 5 forms a depth-needling shaped wire-passing portion 5*c* between a forked cross-lengthwise edge portions 5*b*, from which a plurality of wire materials L arranged on one column in the machine direction are simultaneously detachable in a horizontal direction, and forms a pair of air injection holes in the cross-machine direction on an upper surface of the edge portions 5*a* in the cross-machine direction in a manner so as to be communicated with each of laminar air flow space portions 7, whereby a main cooling air a can be injected from each of the air injection holes 5*a* into the laminar air flow space portions 7*b* at an air-flowing speed of from 20 to 50 m/s.

The lower cooling portion 6 has a plurality of plates 6*b* for preventing turbulence flow, which suppress the turbulence of the cooling air provided on opposite portions in the cross-machine direction each beside a portion along a passing orbit direction of each wire material L provided within a body having a substantially rectangular shape in the cross direction of the lower cooling portion 6. Also, the lower cooling portion 6 also forms a plurality of laminar air flow spaces 6*c* of the cooling air separated by neighboring plates 6*b* for preventing turbulence flow in the machine direction and cross-machine direction, so that a secondary cooling air b at an air-flowing speed of from 5 to 15 m/s, being sucked into the main cooling air flowing within the upper air cooling portion flows from an inlet 6*a* into the laminar air flow spaces 6*c*, and allows the plated layers L1 of the plurality of the wire material L immediately after passing through the plate-squeezing portion 3 to cool in a state where turbulence of the secondary cooling air is suppressed to be adjusted into a laminar air flow state. A wire material inserting portion 6*e* having a width wider than the diameter of the wire material L is continuously formed between the plates 6*b* for preventing turbulence flow placed in the opposite cross-machine direction and on front wall portions 6*d* of the lower cooling portion 6 in vertically accorded with the wire material inserting portion 5*c*, so that a plurality of the wire material L can be detached or attached simultaneously in the horizontal direction from the wire material inserting portion 6*e*.

The upper cooling portion 7 has a plurality of plates 7*b* for preventing turbulence flow, which suppresses the turbulence of the cooling air provided on opposite portions in the cross-machine direction each beside a portion along a passing orbit direction of each wire material L provided within a body having a substantially rectangular shape in the cross direction of the upper cooling portion 7. Also, the upper cooling portion 7 also forms a plurality of laminar air flow spaces 7*c* of the cooling air separated by neighboring plates 7*b* for preventing turbulence flow in the machine direction and cross-machine direction, so that the main cooling air a injected from the air injection hole 5*a* flows in the plates 7*b* for preventing turbulence, and allows the plated layers L1 of the plurality of the wire material L immediately after being cooled by the secondary cooling air b to cool in a state where turbulence of the main cooling air is suppressed to be adjusted into a laminar air flow state. A wire material inserting portion 7*e* having a width wider than the diameter of the wire material L is continuously formed between the plates 7*b* for preventing turbulence flow placed in the opposite cross-machine direction and on front wall portions 7*d* of the upper cooling portion 7 in vertically accorded with the wire material inserting portion 5*c*, so that a plurality of the wire material L can be detached or attached simultaneously in the horizontal direction from the wire material inserting portion 7*e*.

The air compressor portion 5, the lower cooling portion 6, and the upper cooling portion 7 are mutually formed in a manner that they can be separated and be unified. The air compressor portion 5 is mounted and fixed on an upper surface an upper mounting portion 6*f* of the lower cooling portion 6. The position of mounting the air compressor portion 5 is aligned by an upper guide 6*g* of the mounting portion 6*f*. By being aligned by a guide 5*s*, the upper cooling portion 7 is mounted on an upper surface of the air compressor potion 5 so as to detach the parts from each other at the time of maintenance of the air cooling device 4, at the time of the breakage of the wire materials L or such, dealing with such situation quickly.

By such a configuration, two laminar air flows each having different speeds, i.e., a high speed and a low speed, specifically, the main cooling air a and the secondary cooling air b are generated in one air cooling device 4, whereby the high temperature plated layer, easily generating thickness deviation immediately after the plate-squeezing portion 3 is cooled by the laminar air follow, which is the low speed secondary cooling air b, and then, the low temperature plated layer L1, which is relatively difficult to generate the thickness deviation, is cooled by the laminar air follow, which is a high speed main cooling air a to thereby effectively cool the plated layer L1 with being prevented from thickness deviation.

FIG. 7 to FIG. 12 show another embodiment of the apparatus for plating a wire material according to the present invention, whose configurations are basically similar to those of FIG. 1 described above. Consequently, common portions are assigned to the same numbers or symbols, description thereof are omitted, and only configurations will be described.

The air cooling portion 4 is formed by assembling the air compressor portion 5, the lower cooling portion 6, and the upper cooling portion 7 with each other, the wire-passing portion 5*c* of the air compressor portion 5 is formed into a long hole so that a plurality of wire materials in a parallel form can be simultaneously passed. Also, the wire material inserting portion 6*e* on front wall portion 6*d* of the lower cooling portion 6 and the wire material inserting portion 7*e* on the front wall portion 7*d* of the upper cooling portion are omitted.

By such a configuration, two laminar air flows each having different speeds, i.e., a high speed and a low speed, specifically, the main cooling air a and the secondary cooling air b are generated in one air cooling device 4, whereby the high temperature plated layer, easily generating thickness deviation immediately after the plate-squeezing portion 3 is cooled by the laminar air follow, which is the low speed secondary cooling air b, and then, the low temperature plated layer L1, which is relatively difficult to generate the thickness deviation, is cooled by the laminar air follow, which is a high speed main cooling air a to thereby effectively cool the plated layer L1 with being prevented from thickness deviation.

Figure 7:
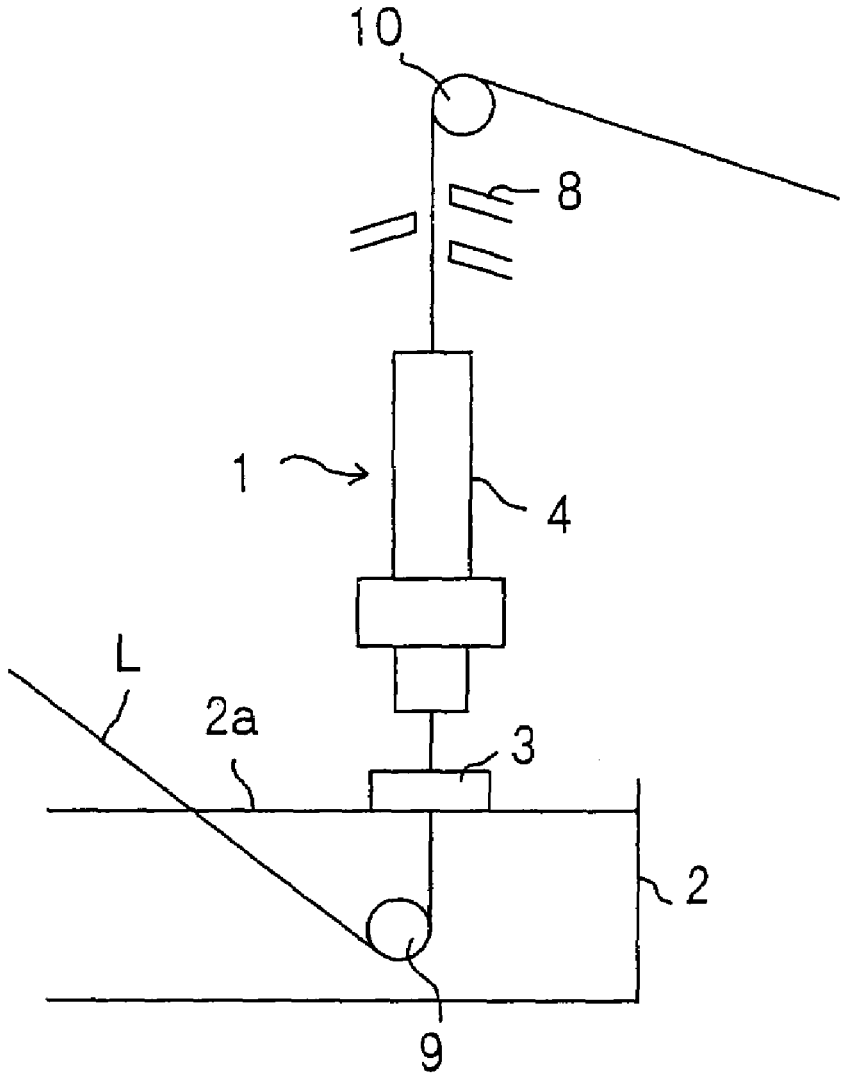
FIG. 7 is a schematic view showing the apparatus for plating a wire material according to another embodiment of the present invention.
Figure 8:
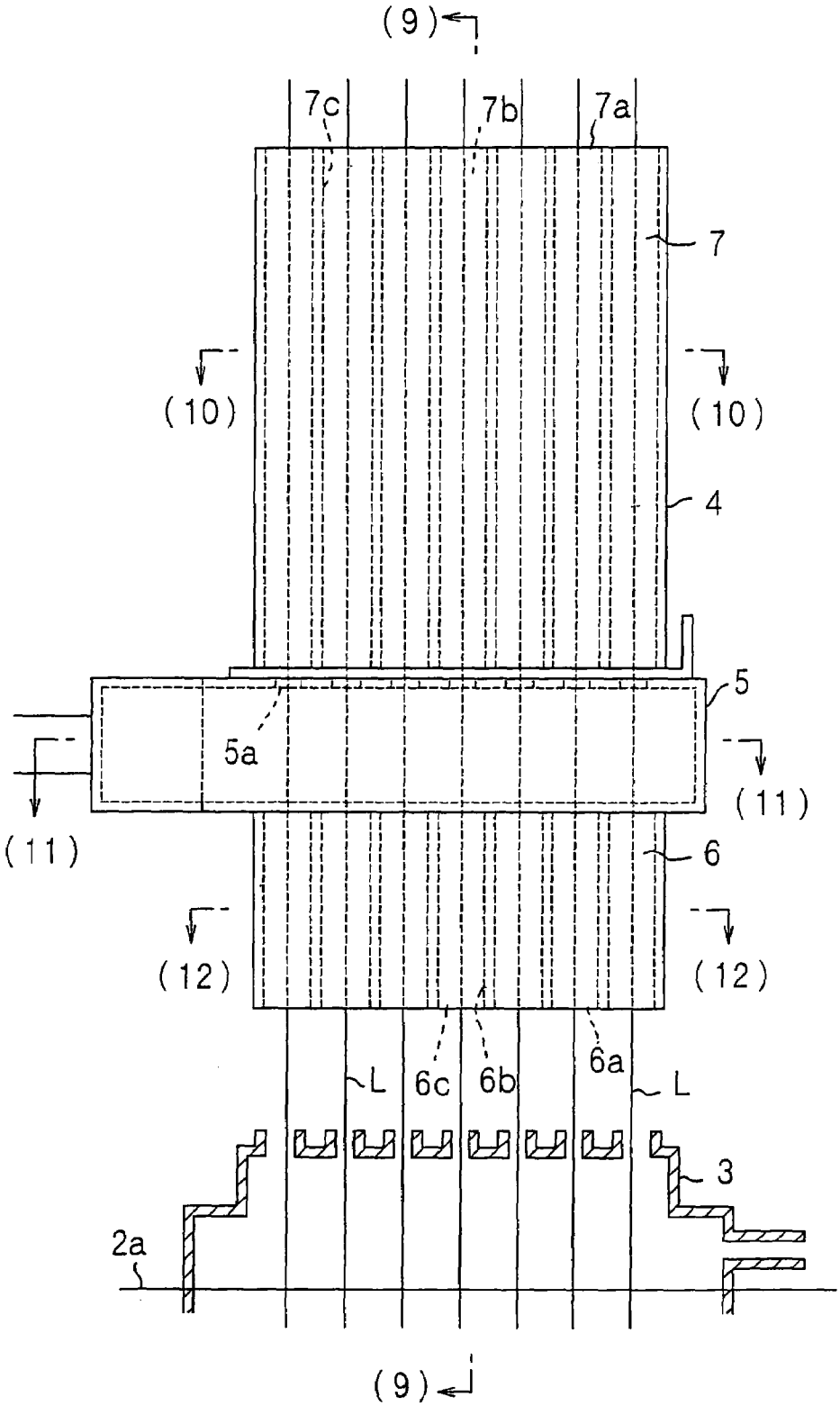
FIG. 8 is an enlarged plane view of the air cooling device of FIG. 7.
Figure 9:
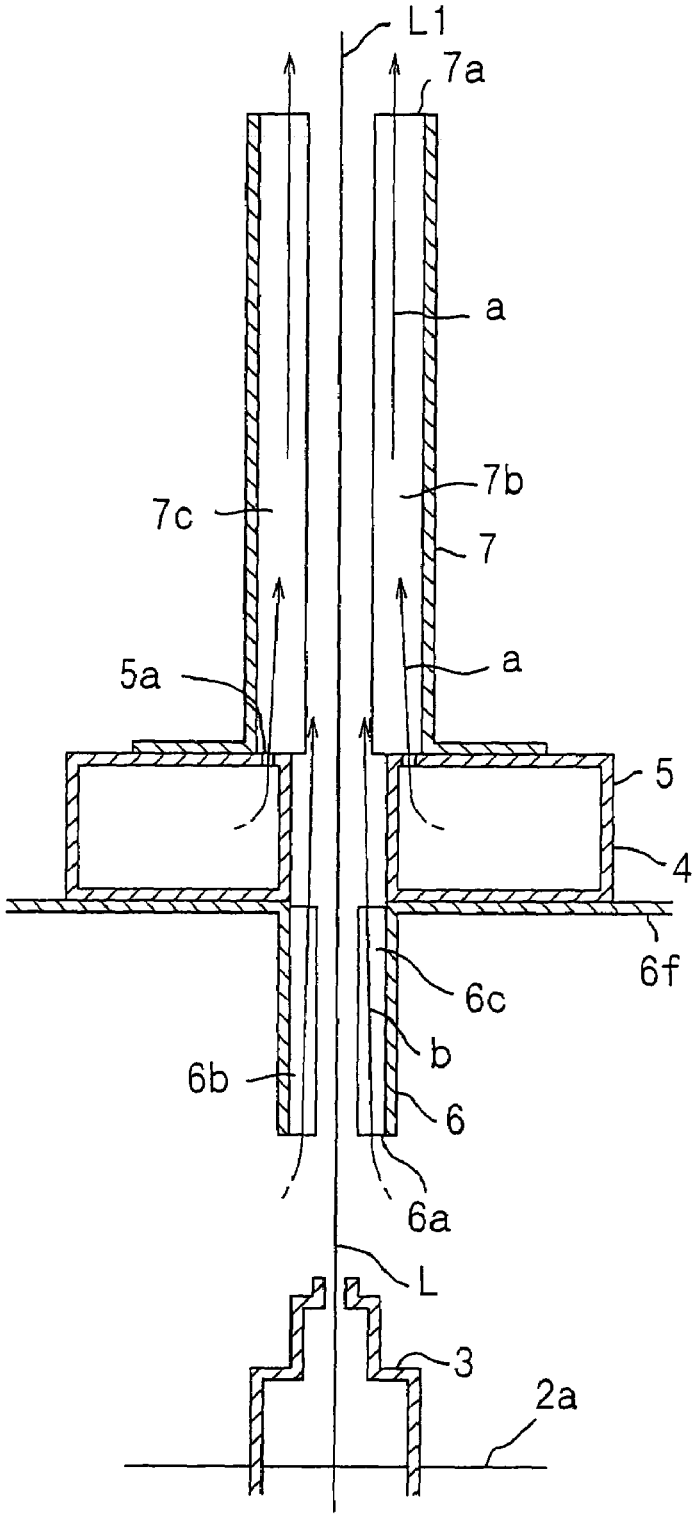
FIG. 9 is a cross-sectional view of FIG. 8 taken along line (9)—(9)
Figure 10:
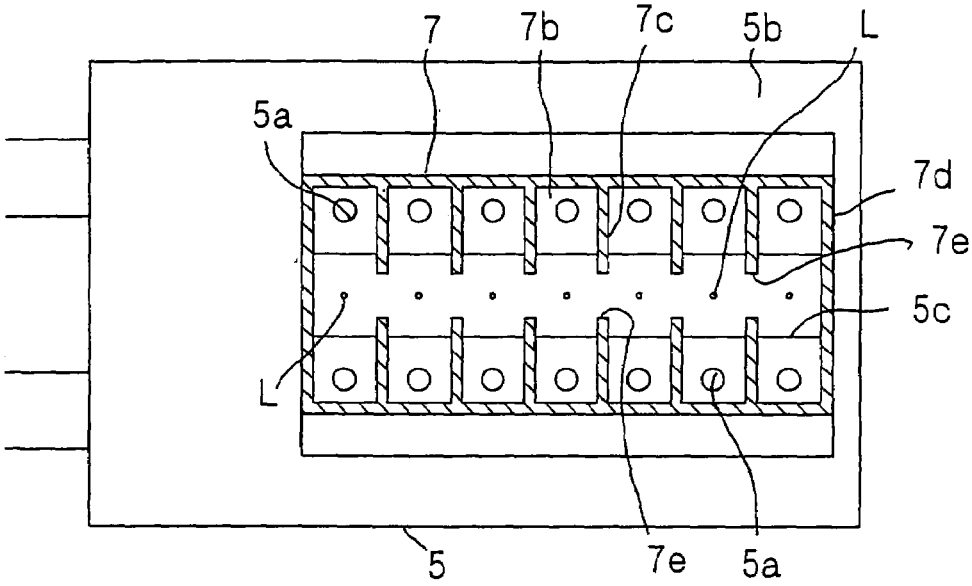
FIG. 10 is a cross-sectional view of FIG. 8 taken along line (10)—(10)
Figure 11:
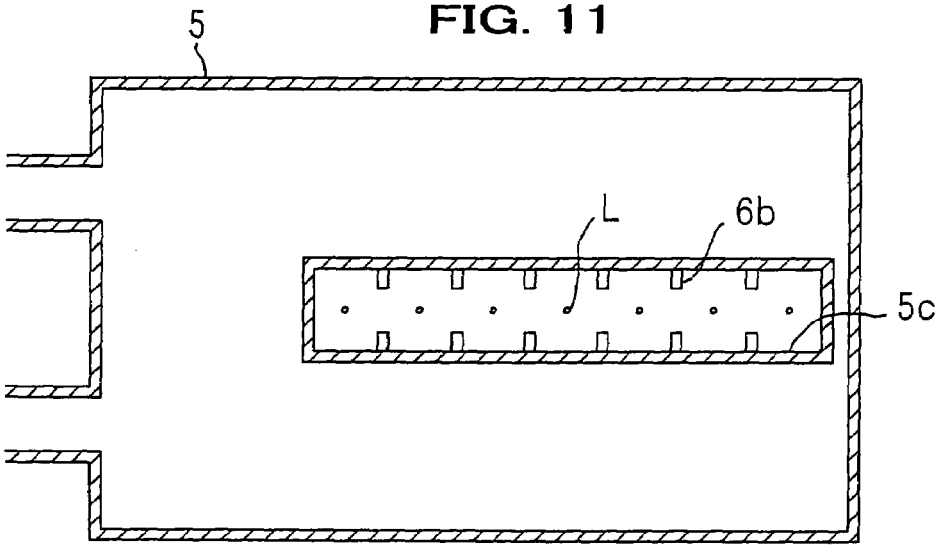
FIG. 11 is a cross-sectional view of FIG. 8 taken along line (11)—(11)
Figure 12:
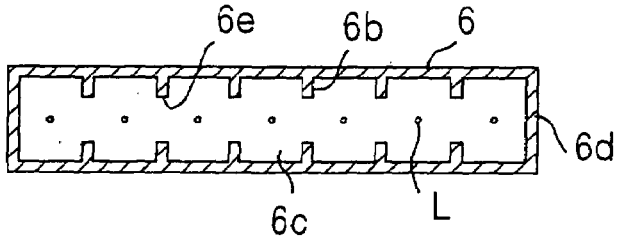
FIG. 12 is a cross-sectional view of FIG. 8 taken along line (12)—(12)
Figure 13:
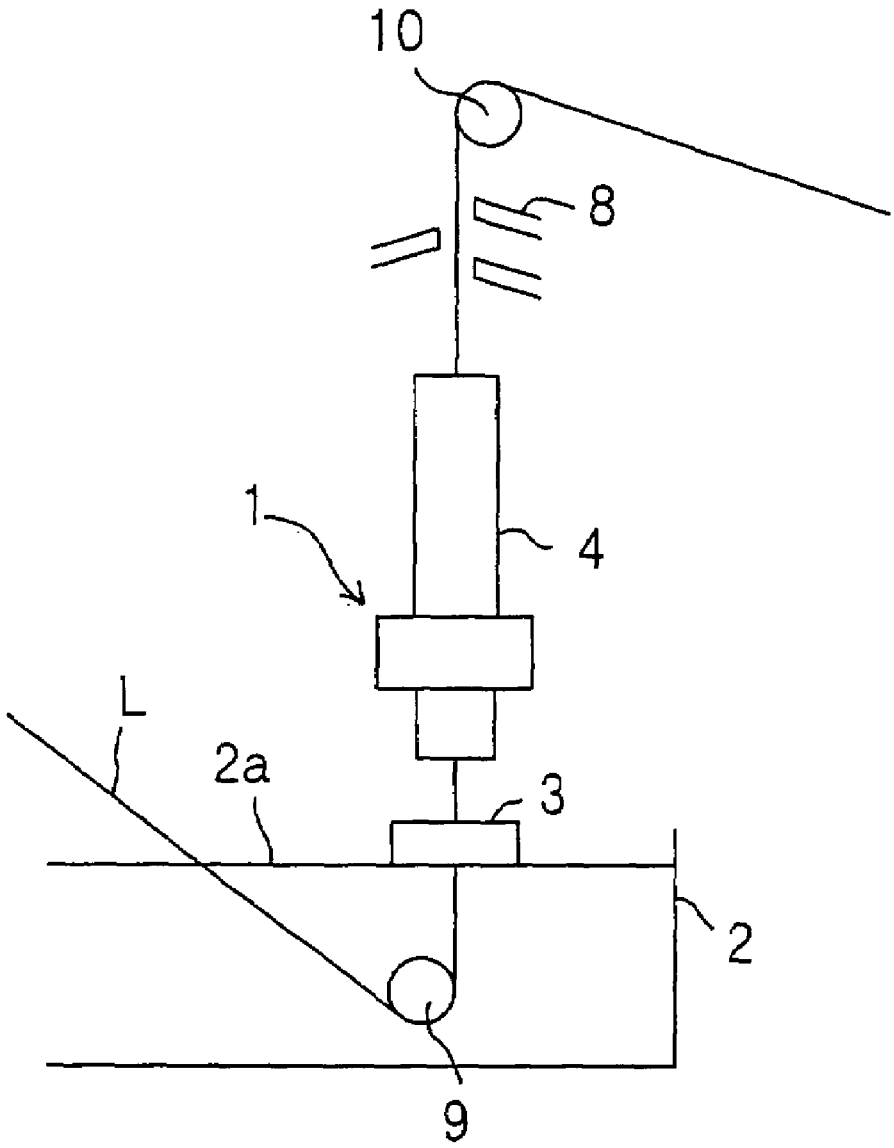
FIG. 13 is a schematic view showing the apparatus for plating a wire material according to still another embodiment of the present invention.
Figure 14:
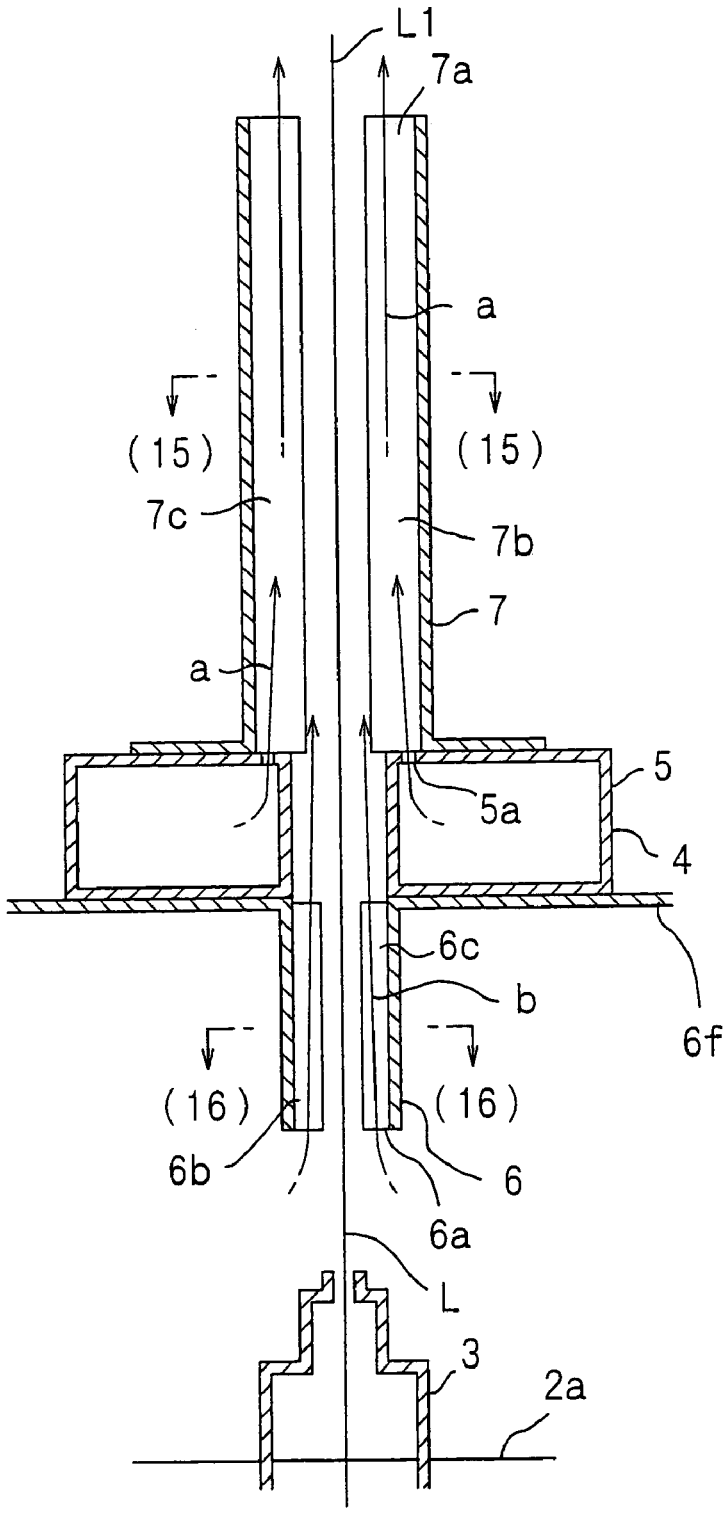
FIG. 14 is an enlarged plane view of the air cooling device of FIG. 13.
Figure 15:
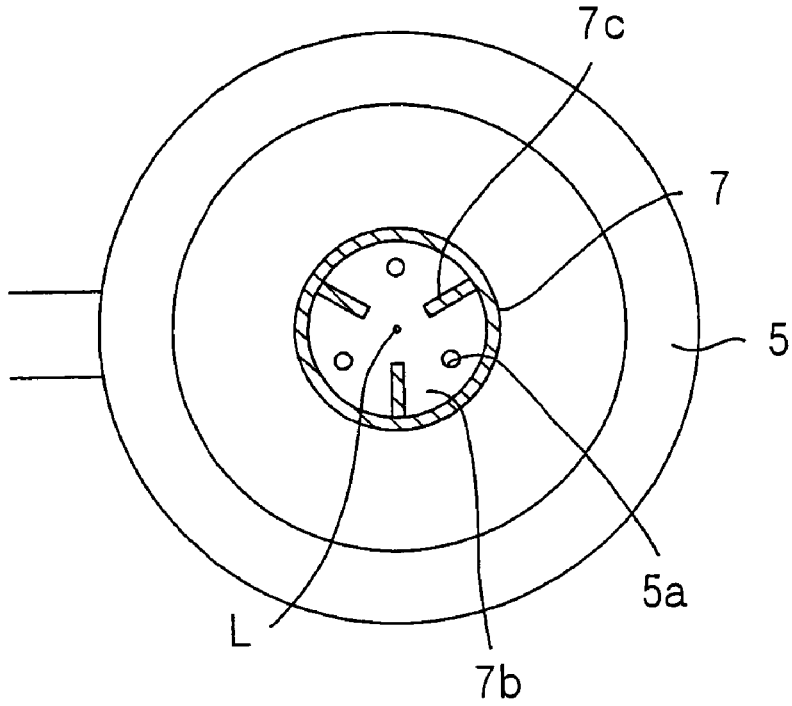
FIG. 15 is a cross-sectional view of FIG. 14 taken along line (15)—(15)
Figure 16:
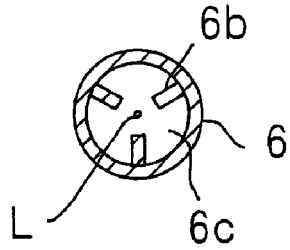
FIG. 16 is a cross-sectional view of FIG. 14 taken along line (16)—(16)

FIG. 13 to FIG. 16 show still another embodiment of the apparatus for plating a wire material according to the present invention, whose configurations are basically similar to those of FIG. 7 described above. Consequently, common portions are assigned to the same numbers or symbols, description thereof are omitted, and only configurations will be described.

The air cooling device 4 is formed so that one wire material L can be air-cooled, the plate 6*b* for preventing turbulence flow, which suppresses the turbulence of the secondary cooling air b provided within a body of the lower cooling portion 6 having a substantially circular cross section in three ways in substantially the same angle along the passing orbit direction of the wire material L1, and the laminar air flow spaces 6*c* of secondary cooling air b is formed. Similarly, the plate 7*b* for preventing turbulence flow, which suppresses the turbulence of the main cooling air a provided within a body of the upper cooling portion 7 having a substantially circular cross section in three ways in substantially the same angle along the passing orbit direction of the wire material L1, and the laminar air flow spaces 7*c* of the cooling air is formed. The plate 6*b* for preventing turbulence flow of the lower cooling portion 6 and the plate 7*b* for preventing turbulence flow of the upper cooling portion 7 are formed to be vertically accorded with each other, whereby they are linearly continued from the lower laminar air flow space 6*c* to the upper laminar air flow space 7*c* via the wire-passing portion 5*c*.

Figure 17:
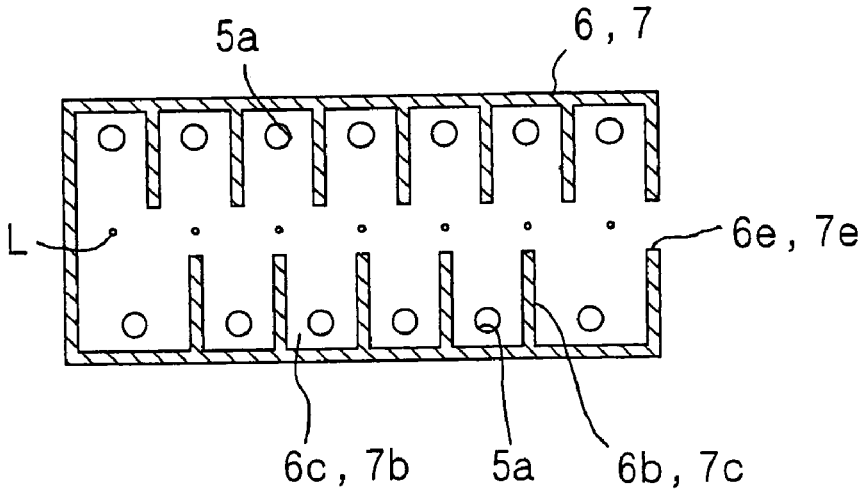
FIG. 17 is a cross-sectional view showing the air cooling device in the apparatus for plating a wire material according to still another embodiment of the present invention.
Figure 18:
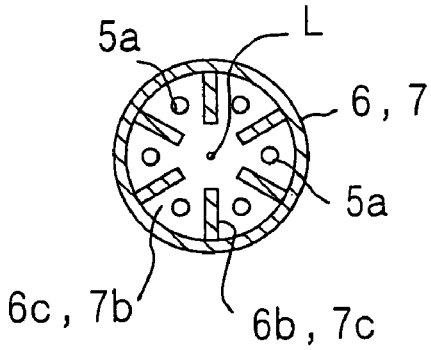
FIG. 18 is a longitudinal cross-sectional view showing the air cooling device in the apparatus for plating a wire material according to still another embodiment of the present invention.
Figure 19:
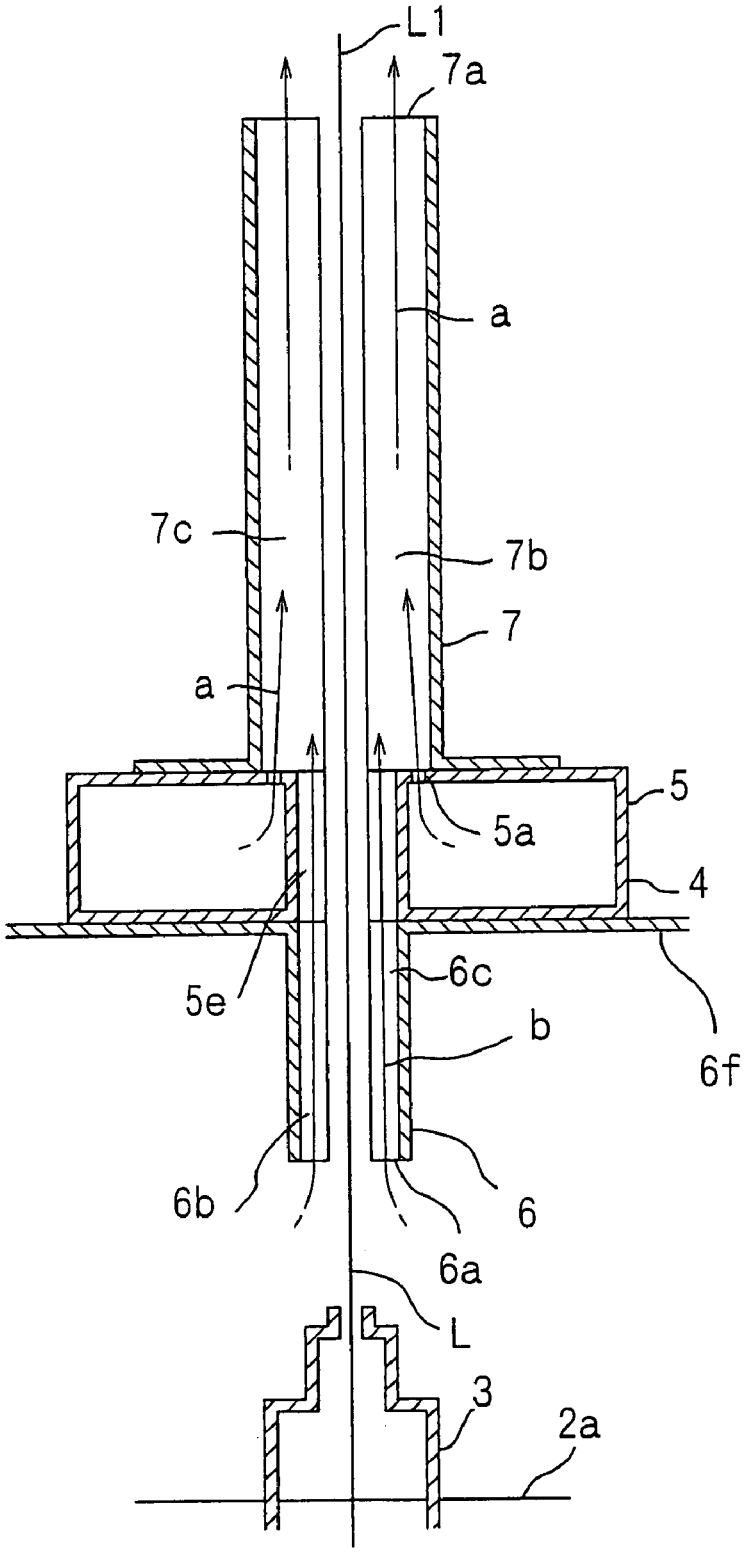
FIG. 19 is a longitudinal cross-sectional view showing the air cooling device in the apparatus for plating a wire material according to still another embodiment of the present invention.

The embodiments described above are illustrative and the present invention should not be restricted thereto. For example, the positional relationship amongst the wire materials L, the air injection hole 5*a* and the plates 6*b* and 7*b* for preventing turbulence in the air compressor portion 5, the lower cooling portion 6, and the upper cooling portion 7, and the configurations of the laminar air flow spaces 6*c* and 7*b* may be formed as shown in FIG. 17 to FIG. 19. The configurations are voluntary without departing from the sprits and scope of the present invention. In FIG. 19, a plate 5*e* for preventing turbulence is provided within the wire-passing portion 5*c* of the air compressor portion 5, and the plate 5*e* for preventing turbulence is intervened between the plates 6*b* and 7*b* for preventing turbulence, and these plates are vertically continuously accorded with each other, the secondary cooling air b being sucked in the main cooling air is suppressed to become turbulence, flows in the laminar air flow space 7*c* of the upper cooling portion 7 in the state of the laminar air flow as is and then is jointed to the main cooling air a. The water cooling device 8 is used in combination with the air cooling device 4 for cooling, the present invention is not restricted thereto. For example, the plated layer L1 is non-eutectic and whose surface coarseness is required to be large, the water cooling device 8 is not used.

INDUSTRIAL APPLICABILITY

As described above, in the apparatus for plating a wire material according to the present invention, a plated layer where the temperature is high and flowability is large, thus, easily generating thickness deviation in the wire material immediately after being passed through the plate-squeezing portion is allowed to cool by the secondary cooling air in the laminar air flow state at a low speed, and the plated layer where the temperature is low and the flowability, thus generating thickness deviation only with difficulty, immediately after the cooling by the secondary cooling air is allowed to cool by the main cooling air by a main cooling air in the laminar air flow state at a high speed, whereby effective cooling with suppressing the thickness deviation can be performed, and uniformly thick-plated wires having a small thickness deviation equal to or smaller than that of the conventional product and having good outward appearance can be produced on a large scale in a stable manner.

The invention claimed is:

1. An apparatus for plating a wire materials, comprising:

an air cooling device provided over an upper portion of a plate-squeezing portion on a plating bath surface so that the wire materials are disposed vertically with respect to the plating bath via the plate-squeezing portion, said air cooling device comprising an air compressor portion, a lower cooling portion below the air compressor portion, and an upper cooling portion above the air compressor portion, wherein the wire materials passing through the air cooling device are air-cooled in two stages by a main cooling air flowing from an air injection hole of said air compressor portion into the upper cooling portion then flowing out from the upper cooling portion from an exit at an upper end and by a secondary cooling air, being sucked into said main cooling air, flowing from an inlet of the lower cooling portion at the lower end thereof into the lower cooling portion and then being joined to the main cooling air; and a plurality of plates for preventing turbulence flow, which suppress the turbulence of the cooling air provided on opposite portions in the cross-machine direction each beside a portion along a route through which each of the wire materials passes arranged in one column in the machine direction to form a plurality of laminar air flow spaces of the cooling air separated by the plurality of plates for preventing turbulence flow in the machine direction and cross-machine direction, and wherein the air injection hole of the air compressor portion is communicated with each laminar air flow space, whereby the wire materials can be simultaneously allowed to cool within the laminar air flow spaces.

2. An apparatus for plating wire materials, comprising:

an air cooling device provided over an upper portion of a plate-squeezing portion on a plating bath surface so that the wire materials are disposed vertically with respect to the plating bath via the plate-squeezing portion, said air cooling device comprising an air compressor portion, a lower cooling portion below the air compressor portion, and an upper cooling portion above the air compressor portion, wherein the wire materials passing through the air cooling device are air-cooled in two stages by a main cooling air flowing from an air injection hole of said air compressor portion into the upper cooling portion then flowing out from the upper cooling portion from an exit at an upper end and by a secondary cooling air, being sucked into said main cooling air, flowing from an inlet of the lower cooling portion at the lower end thereof into the lower cooling portion and then being joined to the main cooling air, wherein the wire materials, arranged on one column between forked cross-machine edge portions of said air compressor portion simultaneously form depth-needling shaped wire-passing portions, are simultaneously detachable, which comprises a plurality of plates for preventing turbulence flow, which suppress the turbulence of the cooling air provided on opposite portions in the cross-machine direction each beside a portion along a route through which each of the wire materials passes arranged in one colunm in the machine direction to form a plurality of laminar air flow spaces of the cooling air separated by the plurality of plates for preventing turbulence flow in the machine direction and cross-machine direction, and a wire material inserting portion having a width wider than the diameter of the wire materials provided between the plates for preventing turbulence flow placed in the opposite cross-machine direction and on front wall portions of the upper and the lower cooling portion in vertically accorded with the wire material inserting portion, and a pair of the air injection holes on both edges of said forked portions of said air compressor portion are with each laminar air flow space, whereby the wire materials can be simultaneously allowed to cool within the laminar air flow spaces.

* * * * *